US005181787A

United States Patent [19]

Hosomi

[11] Patent Number: 5,181,787

[45] Date of Patent: Jan. 26, 1993

[54] THERMAL LINE PRINTER HAVING A ROTATABLE HEAD HOLDING MEMBER

[75] Inventor: Hiroaki Hosomi, Suwa, Japan

[73] Assignee: Seiko Epson Corporation, Tokyo, Japan

[21] Appl. No.: 720,312

[22] Filed: Jun. 25, 1991

[30] Foreign Application Priority Data

| | | | |
|---|---|---|---|
| Jun. 26, 1990 | [JP] | Japan | 2-67554 |
| Jun. 26, 1990 | [JP] | Japan | 2-67555 |
| Jun. 26, 1990 | [JP] | Japan | 2-167382 |
| Jun. 26, 1990 | [JP] | Japan | 2-167383 |
| Mar. 28, 1991 | [JP] | Japan | 3-64868 |

[51] Int. Cl.[5] ..... B41J 2/32

[52] U.S. Cl. ..... 400/120; 400/55

[58] Field of Search ..... 400/120, 55, 356; 346/76 PH, 145

[56] References Cited

U.S. PATENT DOCUMENTS

| | | | |
|---|---|---|---|
| 4,507,666 | 3/1985 | Kondo et al. | 346/76 PH |
| 4,647,233 | 3/1987 | Noda et al. | 400/120 |
| 5,005,026 | 4/1991 | Sakai | 400/120 |

FOREIGN PATENT DOCUMENTS

| | | | |
|---|---|---|---|
| 3616925 | 4/1987 | Fed. Rep. of Germany | 400/120 |
| 64042 | 6/1978 | Japan | 400/120 |
| 191175 | 11/1983 | Japan | 400/120 |
| 58-188682 | 2/1984 | Japan . | |
| 59-182763 | 10/1984 | Japan . | |
| 255469 | 12/1985 | Japan | 400/120 |

*Primary Examiner*—Clifford D. Crowder
*Assistant Examiner*—Stephen R. Funk
*Attorney, Agent, or Firm*—Blum Kaplan

[57] ABSTRACT

A thermal line printer includes a frame. The head holding member is rotatably mounted on the frame and holds a thermal head therein. The thermal head holding member is biased towards the platen by a spring. A first level cooperates with a head holding member to separate the thermal head from the platen. A second lever member cooperates with an auxiliary member to rotate the auxiliary member through a large angle. The head holding member engages the auxiliary member and further rotates through a large angle to move the thermal head further away from the platen.

27 Claims, 18 Drawing Sheets

THERMAL LINE PRINTER HAVING A ROTATABLE HEAD HOLDING MEMBER

BACKGROUND OF THE INVENTION

The present invention relates in general to a line thermal printer and, in particular, to a mechanism for supporting and raising the thermal head relative to the platen.

Thermal line printers are known in the art as disclosed in Japanese Utility Model Laid Open Application No. 164/85. This prior art printer includes a platen and thermal head. Heat sensitive paper is disposed between the platen and the thermal head. Rotation of the platen produces a frictional force for feeding the paper. When the heat sensitive paper is to be inserted into position, a lever is operated to actuate a head lifting mechanism to raise the thermal head to provide the required spacing between the platen and the thermal head to allow insertion of the paper. When the printer is not to be used for a long time, the head lifting mechanism is utilized to raise the thermal head from the platen to prevent deformation of the platen. For these purposes, the thermal head is raised a distance ranging from several millimeters to less than 10 millimeters.

To perform preventive maintenance to the thermal head, such as cleaning the thermal head surface, it is required that screws be removed and that the head support structure be disassembled or deformed. This exposes the surface of the thermal head to be maintained. In another method for servicing the head known from Japanese Laid Open Patent Application No. 134274/88, the entire thermal head is detached.

Generally, thermal line printers maintain the heat sensitive paper disposed along each print line and require an accuracy equal to the dot pitch. Therefore, print quality is greatly affected by the accuracy at which the heat generating portion of the thermal head is positioned relative to the platen. It follows that positioning accuracy is an important factor affecting print quality.

These prior art mechanisms have been satisfactory. However, it is difficult to accurately establish the position of the heat generating portion of the thermal head during printing once the thermal head has been repeatedly operated as is required in the above prior art structures. Continual disassembly or removal of the thermal head causes the positioning of the thermal head to deviate from the optimum position resulting in low print density. Additionally, the prior art thermal line printers are not easily operated. When a maintenance operation is to be performed, the head is disassembled, i.e., the screws are detached. This is a cumbersome operation to perform. During such an operation, there is an additional possibility that one of the screws which has been removed will fall into the printer, causing an electrical short circuit on the circuit board resulting in breakdown of the apparatus. Additionally, screws are easily lost. Once the head is disassembled, the heat generating portion of the head tends to shift from its proper position. Further, if the head must be frequently mounted and removed, then the connectors coupled with the head are easily damaged.

Many of the above described prior art mechanisms utilize an assembly for biasing the head toward the platen including spring members and structures for holding the spring members each of which are mounted near the top of the thermal head. Such a structure increases the total height of the printer resulting in a waste of space which prevents miniaturization of the printer. Additionally, when a paper cutter was incorporated into the printer, it was fixedly mounted to the printer, providing an impediment to the raising of the thermal head and greatly impeding access to the thermal head.

In many of the prior art thermal line printers, it is sometimes impossible to maintain the head, i.e. to clean the head due to the small space provided Even if it is possible, maintenance of the thermal head itself involves further cumbersome operations. Mechanisms which do lend themselves to maintenance are complicated structures which tend to be large in size.

Accordingly, it is desirable to provide a thermal line printer which overcomes the shortcomings of the prior art devices described above.

SUMMARY OF THE INVENTION

Generally speaking, in accordance with the invention, a thermal line transfer printer having an improved thermal head support mechanism is provided. The thermal head is disposed in a rotating head holding member. The rotating head holding member includes a first engaging portion and a second engaging portion. A first lever formed with a cam bears against the first engaging portion of the head holding member. Actuation of the lever moves the thermal head away from the platen of the thermal printer. A rotating auxiliary member which includes an engaging portion engages the second engaging portion of the head holding member. A spring biases the head holding member away from the auxiliary member. A second lever member is operatively coupled to the auxiliary member and locks the auxiliary member in a given position. When the second lever member is moved and the auxiliary member is unlocked, the auxiliary member interlocks with the head holding member and rotates in a direction to move the thermal head further away from the platen.

It is an object of this invention to provide an improved thermal line printer.

A further object of the invention is to provide a thermal line printer equipped with a lever to which only a few additional parts are added than found in a conventional head lifting mechanism to raise the head to a greater degree to expose the surface of the thermal head.

It is another object of the invention to provide a thermal head lifting mechanism which allows the clearing of paper jams without the need for touching the head, as well as facilitates maintenance of the head without having to detach the head.

Yet another object of the invention is to provide a line thermal printer which maintains an optimum position relation between the head generation portion of the head and the platen, thereby ensuring good print quality.

Still another object of the invention is to provide a thermal line printer which is simple in construction and provides a simple head lifting mechanism which provides greater access to the printer without increasing the size of the printer.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENT

Figure 1:
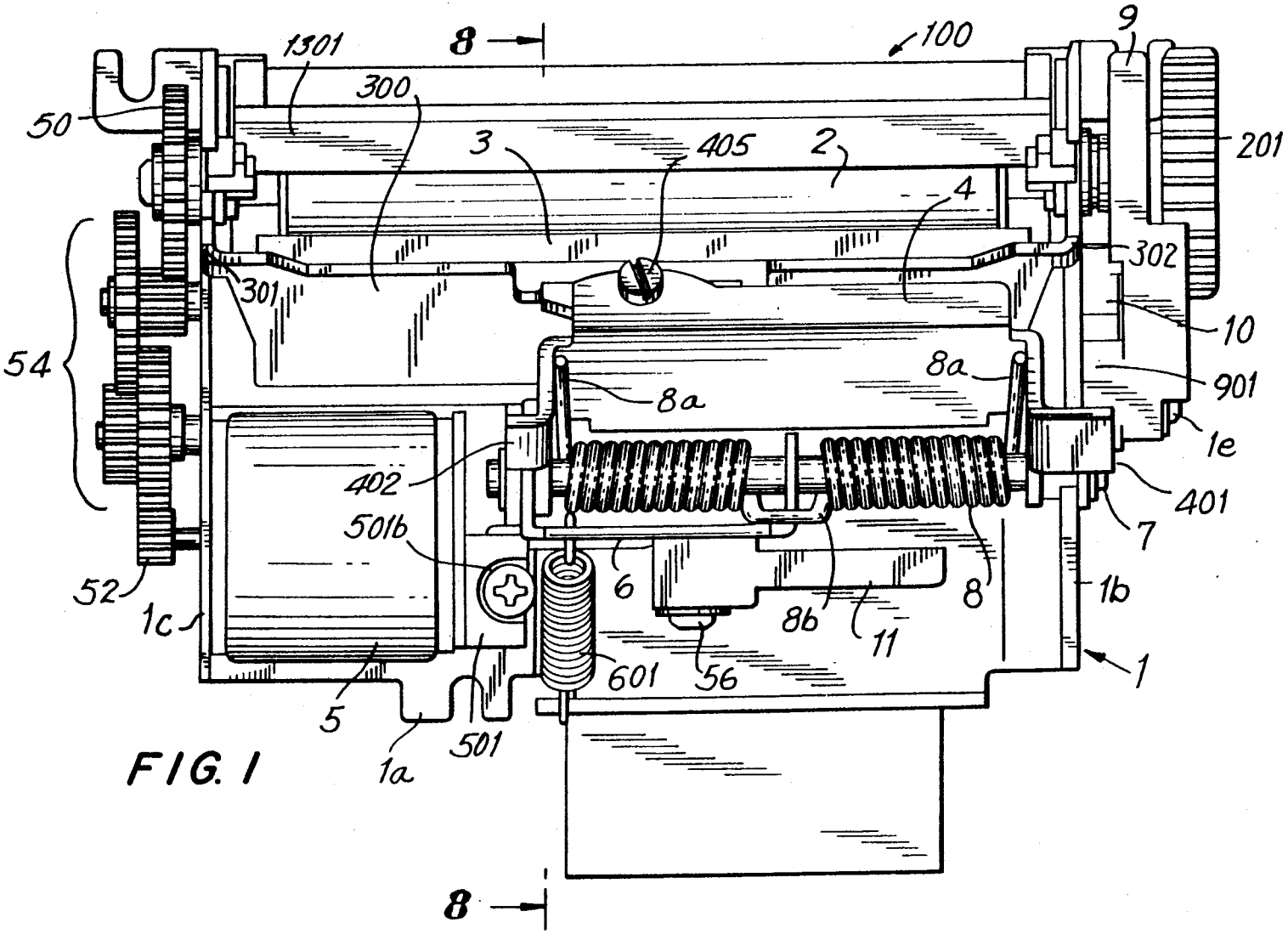
FIG. 1 is a top plan view of a printer constructed in accordance with the invention.

Reference is first made to FIGS. 1-6 in which a thermal line printer, generally indicated as 100, is provided. Thermal line printer 100 includes a frame 1 formed by bending a unitary plate of metal or the like into a substantially U-shape. Frame 1 includes a bottom portion 1*a*, a right side frame portion 1*b* and a left side frame portion 1*c*. A platen 2 formed as a rubber roller is supported by bearings between right side frame portion 1*b* and left side frame portion 1*c*. A manually operated knob 201 is mounted on platen 2 to allow manual rotation of platen 2. Right side frame portion 1*b* is disposed between knob 201 and platen 2 to allow easy access to knob 201. A toothed wheel 50 is mounted on the left end of platen 2 to allow motor diving of platen 2 as will be discussed below in detail.

Figure 6:
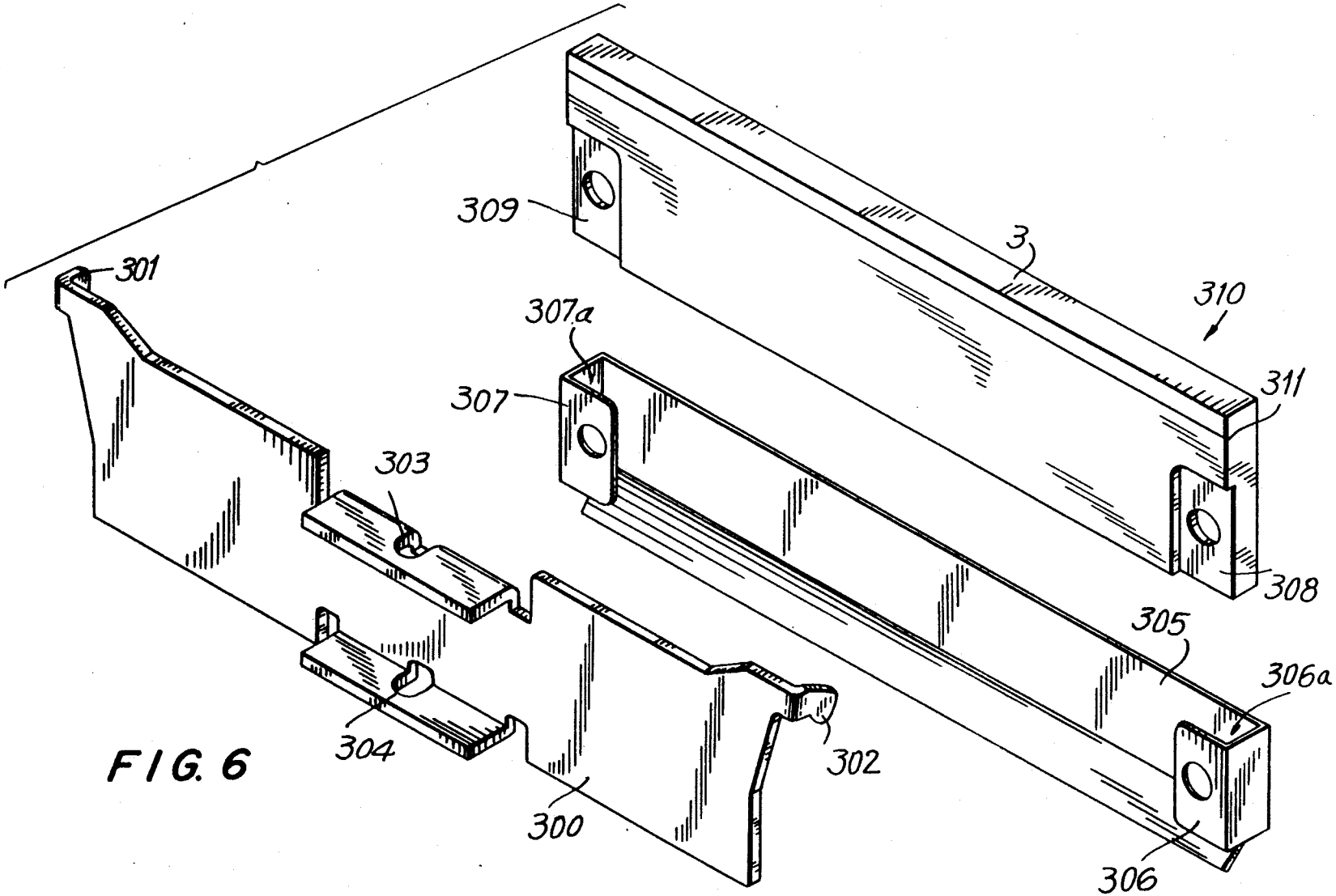
FIG. 6 is an exploded view of the thermal head subassembly constructed in accordance with the invention.
Figure 7:
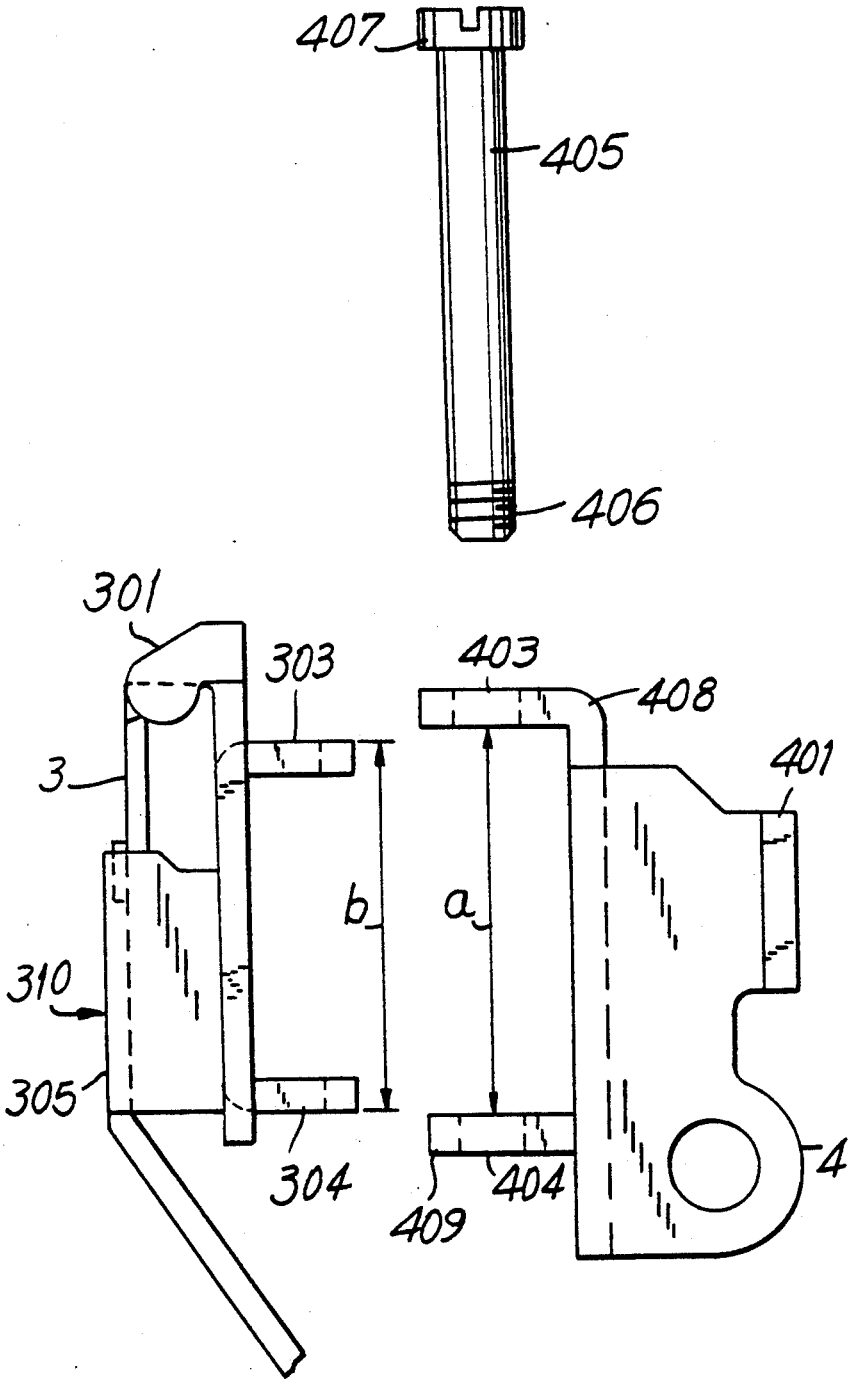
FIG. 7 is an exploded view of a head holding assembly constructed in accordance with the invention.

A holding member 4 is rotatably mounted on frame 1. A head subassembly 310 (FIG. 6) includes a thermal head 3 orthogonally and rigidly mounted on head mount plate 300 by a head cover 305. Head subassembly 310 is connected to head holding member 4 at a central portion thereof by a support shaft 405 (FIG. 7). Head subassembly 310 may swing about shaft 405. The width of head holding member 4 is less than the width of head subassembly 310 as seen in FIG. 1. Head subassembly 310 is mounted to head holding member 4 left of center of head holding member 4. The assembly utilized to press head holding member 4 and head subassembly 310 against platen 2 are mounted primarily on the right portion of frame 1 of printer 100.

In the conventional thermal line printers, the width of the head holding member pushing against the thermal head is set substantially equal to the width of the head subassembly so that the thermal head is pressed against the platen with a force which is uniform in the horizontal direction. However, by constructing a printer in accordance with the invention, the head subassembly 310 is biased toward the platen only by the portion of the head holding assembly defined by shaft 405. In such a structure, the head subassembly 310 need only be held so as to maintain a parallel relationship to platen 2 when head 3 is biased toward platen 2. In printer 100, the width of head holding member 4 can be made small and the location of head holder 4 can be shifted either to the right or left with respect to head subassembly 310 and still maintain the required printing characteristics.

A space is formed within frame 1 behind thermal head subassembly 310 by the reduced width of head holding member 4. An electric motor 5 mounted on bottom frame portion 1*a* of frame 1 is disposed within the space formed on the left side of frame 1. Electric motor 5 is installed without protruding outwardly from the space resulting in a reduced width of the printer leading to miniaturization of the printer. Motor 5 is affixed to left side frame portion 1*c*. A pinion 52 is coupled to motor 5 and engages a gear train 54 mounted on left side frame portion 1*c* to transmit the rotation of pinion 52 to toothed wheel 50 and in turn rotate platen 2. A heat dissipating auxiliary plate 501, formed by bending a metal sheet into an L-shape is mounted on motor 5 by screws 501*a* and affixed to bottom frame portion 1*a* of frame 1 by screws 501*b*.

In a thermal line printer, characters are printed while the paper is being fed. Accordingly, the motor is continuously utilized. For this reason, motor 5 often gets hot, leading to a reduction in torque shortening the motor life. However, utilization of head dissipating auxiliary plate 501 greatly improves heat dissipation when compared to the prior art in which the heat is dissipated only through the surface upon which the motor is mounted. In actual experiments, printer 100 is a small sized thermal line printer operated at 24 volts resulting in a temperature of the motor coil during printing of 130° C. in the absence of heat dissipating auxiliary plate 501. However, in the presence of heat dissipating auxiliary plate 501, the temperature rises to only 120° C. This allows the use of E-type wires as the motor coils since such wires do not properly function at temperatures of 125° C. or greater.

Figure 2:
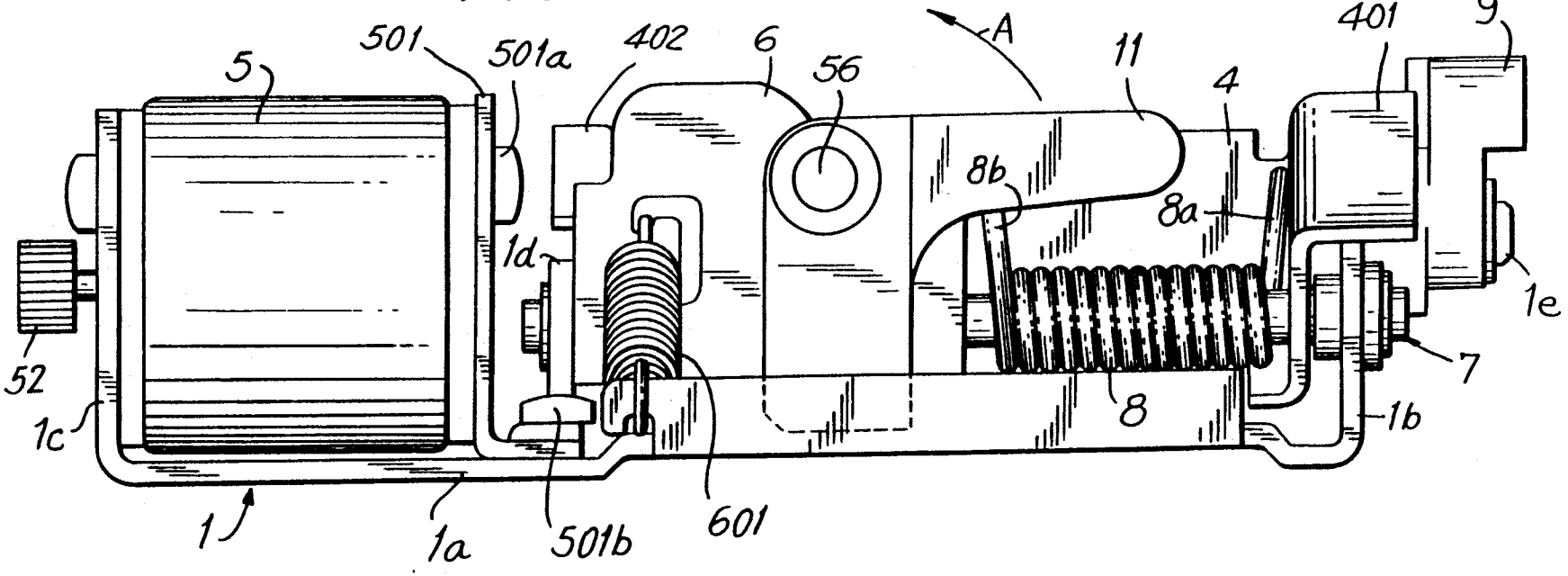
FIG. 2 is a front elevational view of the printer constructed in accordance with the invention.
Figure 3:
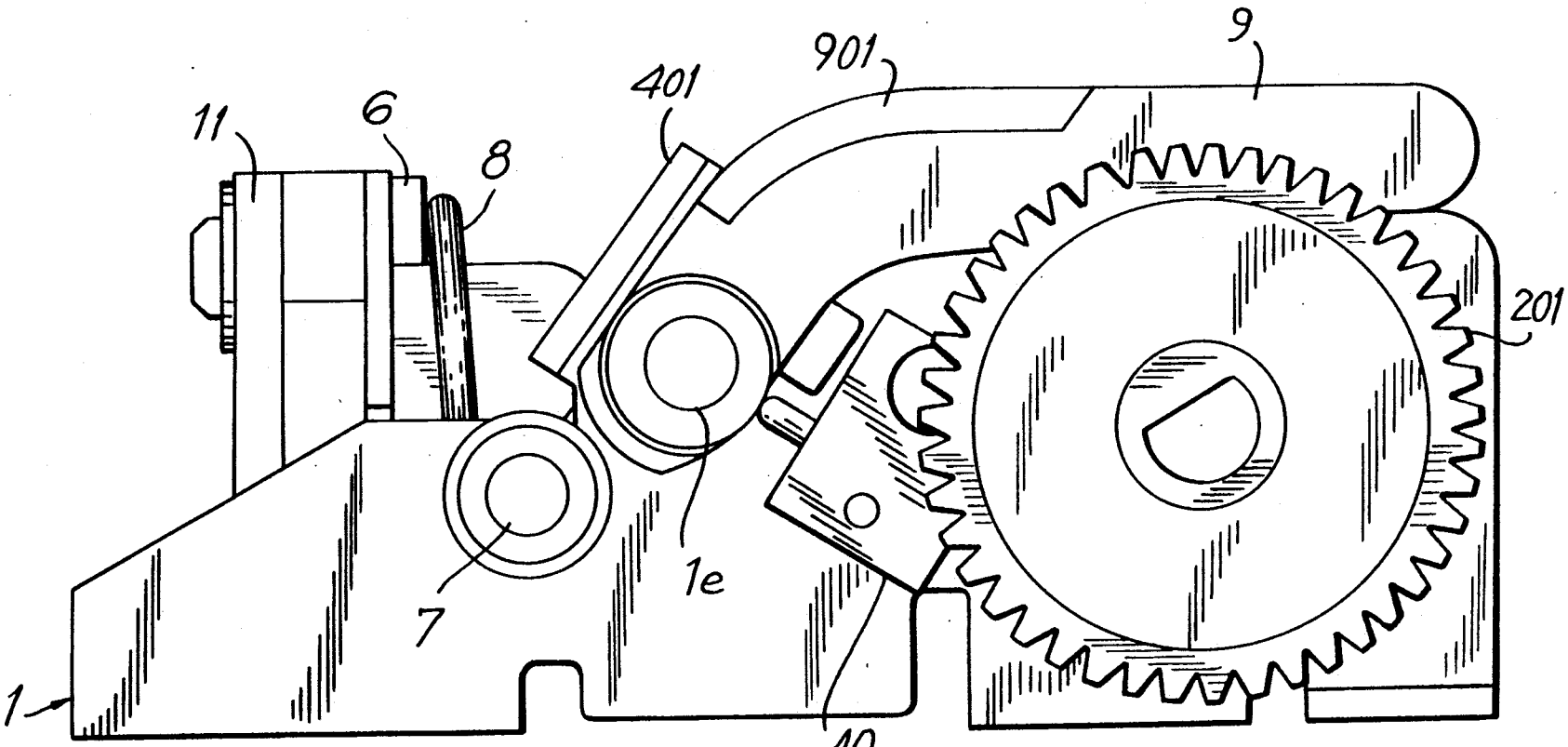
FIG. 3 is a right side elevational view of the printer constructed in accordance with the invention.
Figure 4:
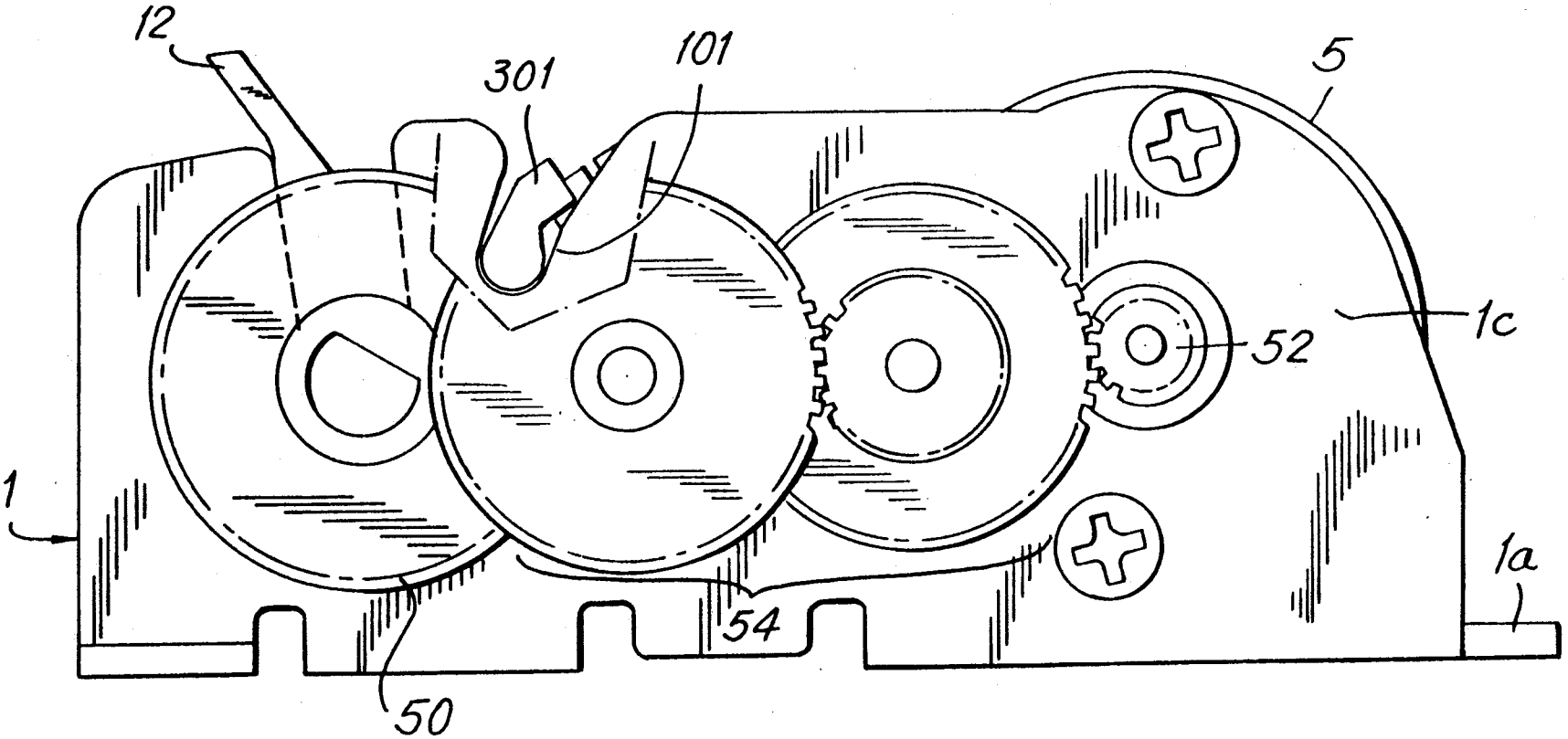
FIG. 4 is a left side elevational view of the printer constructed in accordance with the invention.

A shaft 7 is supported by frame 1, one end of shaft 7 being supported on right side frame portion 1*b*, the other at a bent tab 1*d* formed in frame (FIG. 2). An auxiliary member 6 is rotatably mounted on shaft 7. Head holding member 4 is also rotatably mounted on shaft 7. A spring 8, formed as a torsion coil spring in the exemplary embodiment is also mounted about shaft 7. Spring 8 includes legs 8*a* for biasing head holding member 4 towards platen 2, thus pressing head subassembly 310 against platen 2. A spring portion 8*b* of spring 8 biases auxiliary member 6 away from platen 2.

Head holding member 4 is formed with a first engaging portion 401 and a second engaging portion 402. A first lever member 9 is formed with a cam portion 901 and is mounted on a shaft 1*e* (FIG. 3 extending through a groove formed in right side frame portion 1*b* so that lever 9 is rotatable through a certain range. First engaging portion 401 of head holding member 4 engages cam portion 901 of first lever member 9. The second engaging portion 402 of head holding member 4 engages auxiliary member 6. By operating first lever member 9 it becomes possible to press head subassembly 310 against platen 2 or to move head subassembly 310 away from platen 2. Thermal head 3 is in a down position when pressed against platen 2 and in an up position when moved away from platen 2.

A detector 10 is mounted on right side frame portion 1*b*. Detector 10 is a microswitch which is contacted by lever 9. Microswitch 10 cooperates with lever 9 to control printing so that when thermal head 3 is up motor 5 is stopped, stopping paper feeding and printing.

An auxiliary spring 601 is affixed between bottom frame portion 1*a* and auxiliary member 6 for biasing auxiliary member 6 towards bottom frame portion 1*b*. A second lever 11 is rotatably mounted about a shaft 56 extending through auxiliary member 6. Lever 11 contacts bottom frame portion 1*a* locking auxiliary member 6 in a given position. Second lever member 11 is rotatably mounted about shaft 56. When second lever 11 contacts bottom frame portion 1*a* as shown in FIG. 2, it prevents spring 8 or spring 601 from moving auxiliary member 6. If second lever 11 is rotated in a direction of arrow A then auxiliary member 6 is unlocked and is caused to rotate by the force of spring 601 towards bottom frame portion 1*a*.

Figure 5:
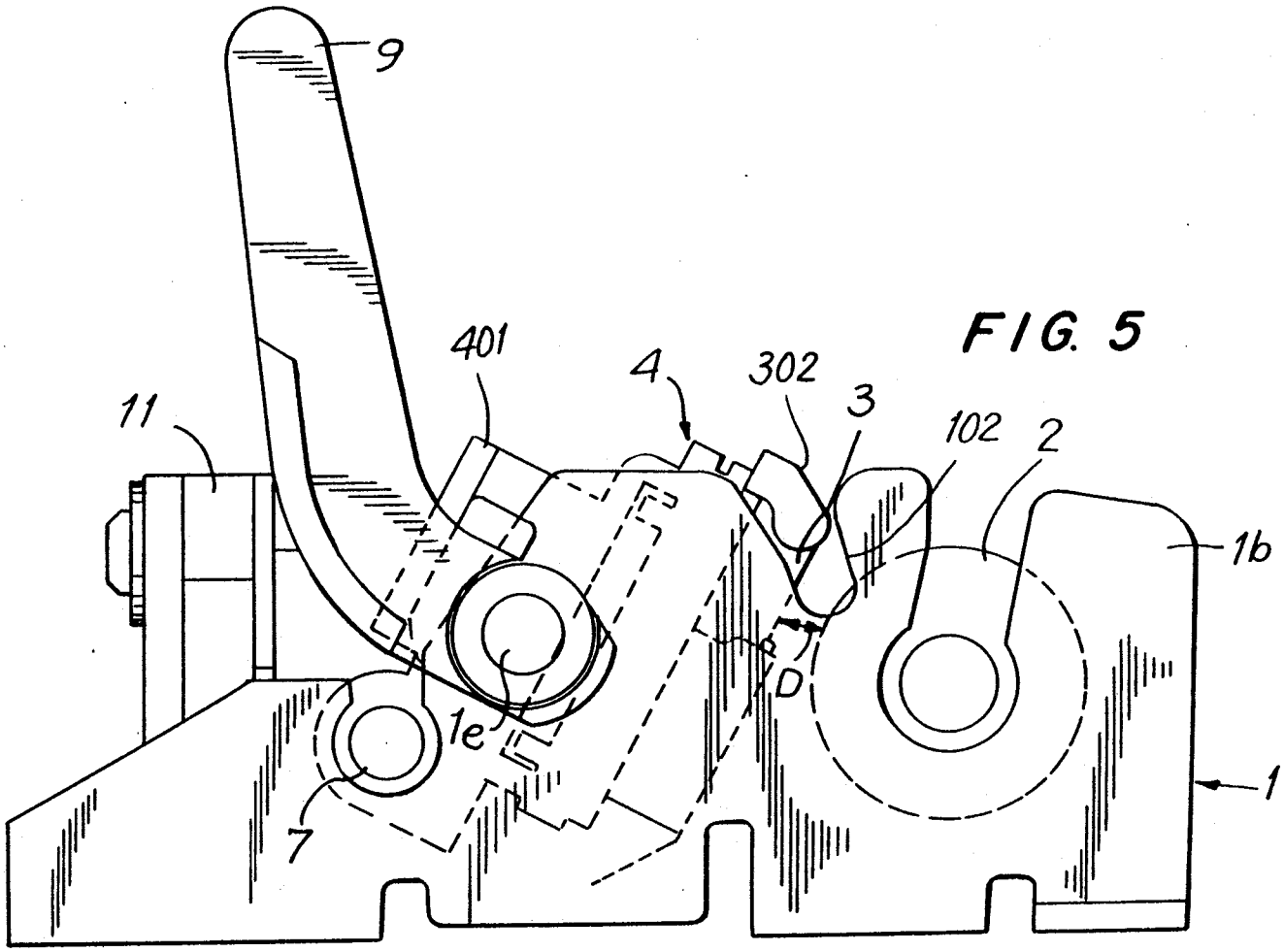
FIG. 5 is a right side elevational view of the printer in which the thermal head is raised.

Reference is now made to FIG. 5 in which movement of thermal head 3 between an up position and down position is shown. When thermal head 3 is in an up position, it is separated from platen 2 by a gap D (FIG. 5). To position thermal head 3 in a proper position, when in a down position, frame left side portion 1*c* is formed with a groove 101 (FIG. 4) therein which functions as a position setting portion for placing thermal head 3 and the head subassembly in proper position. Similarly, a groove 102 is formed in frame right side portion 1*b* symmetrically and parallel with groove 101. Head mount plate 300 of head subassembly 310 is formed with a first engaging portion 301 received by groove 101 and a second engaging portion 302 received by groove 102 (FIG. 6). Engaging portions 301 and 302 move within grooves 101 and 102 respectively when thermal head 3 moves between the up position of FIG. 5 and the down position of FIG. 4.

When thermal head 3 is down, head subassembly 4 is held in position by engaging portions 301 and 302 which rest in grooves 101, 102 respectively. Thermal head 3 is firmly held so that it is maintained in a position parallel to platen 2. The force pressing head subassembly 310 towards platen 2 is horizontally uniform and the central portion of head subassembly 310 is held in a rotatable manner. When thermal head 3 is down, a heat generating element 311 of thermal head 3 is so positioned relative to platen 2 so that optimum printing is accomplished. If thermal head 3 is repeatedly moved up and down, the positional relationship between platen 2 and thermal head 3 when thermal head 3 is in the down position, is kept constant at all times so that good printing can be stably affected.

Reference is now made to FIGS. 6 and 7 in which substructures of the printer such as the head subassembly are shown in greater detail. Head subassembly 310 includes a head cover 305 in which an exemplary embodiment is formed by bending a sheet of stainless steel. Head cover 305 includes a left bent portion 306 and a right bent portion 307 forming slots 306*a* and 307*a* respectively. Thermal head 3 is formed with steps 308 and 309 each having a height substantially equal to the width of slots 306*a* and 307*a*, so that thermal head 3 may be received by cover 305. A driver integrated circuit ("IC") and a flat pack integrated circuit ("FPC") (not shown) are coupled to thermal head 3 for activation thereof. The connections between the driver IC and FPC and the head 3 are protected by head cover 305. Head mount plate 300 is formed with engaging portions 301 and 302 at the opposed ends thereof. Engaging portions 301, 302 are symmetrically positioned relative to plate 300. Plate 300 is formed with centrally located support shaft holes 303 and 304.

Reference is now made to FIG. 7 in which head holding member 4 for supporting head subassembly 310 is shown. Head holding member 4 is formed with an upper bent portion 408 having a support shaft hole 403 formed therein, and a lower bent portion 409 having a support shaft hole 404 formed therein. A support shaft 405 is received through support shaft holes 303, 403, 304 and 404. Support shaft 405 is formed with an external thread 406 at one end and a slotted head 407 at its other. Support shaft hole 404 is internally threaded to mate with the external thread 406 of support shaft 405 for maintaining support shaft 405 in place. In this way, head subassembly 310 is held by head holding member 4.

A distance a between bent portions 408, 409 is greater than a distance b between the external surfaces of support holes 303, 304 of head mount plate 300 so that head mount plate 300 can be received by head holding member 4. Support shaft holes 303 and 304 are larger than the diameter of support shaft 405 so that head subassembly 310 forms a gap between itself and support shaft 405. Head subassembly 310 is usually replaced when thermal head 3 is in the open position by rotating head 407 with a screw driver, coin or the like and removing support shaft 405.

Figure 8:
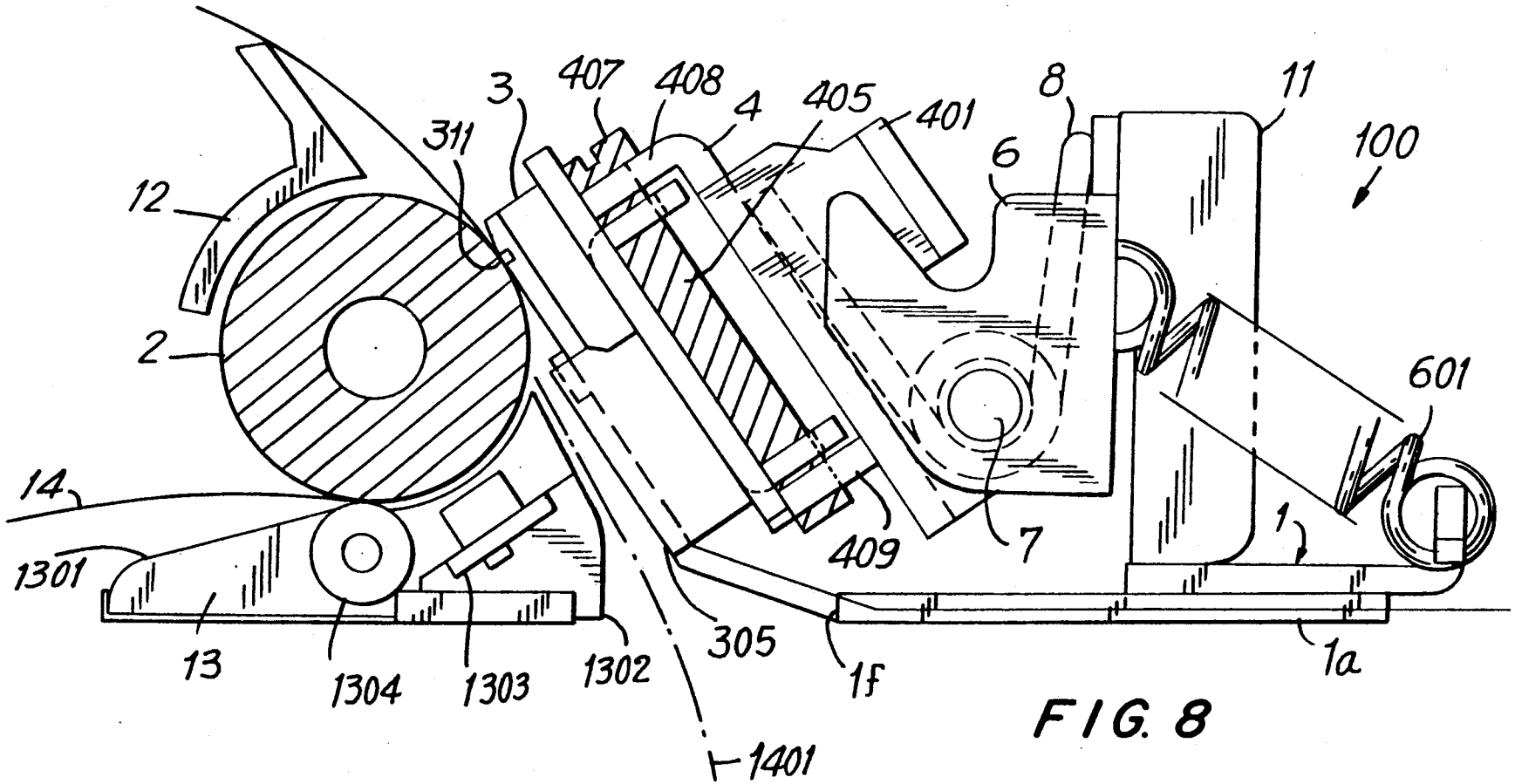
FIG. 8 is a cross-sectional view taken along lines 8—8 of FIG. 1 in which the thermal head is in a down position.

Reference is now made to FIG. 8 in which a sectional view of printer 100 is provided. A paper guide 13 is mounted on bottom frame portion 1*a* of frame 1. Paper guide 13 is formed with two paper insertion channels 1301 and 1302. When normal thermal paper is utilized for printing, thermal paper 14 is passed through paper insertion channel 1301 and wound about platen 2 and exits through a paper guide 12 mounted upstream along the paper feed path of platen 2 to prevent paper 14 from being rewound about platen 2. When thick paper, such as thermal label paper 1401 is utilized, paper 1401 is fed substantially straight through a paper passage hole 1*f* formed in bottom frame portion 1*a* of frame 1 and through paper insertion channel 1302. When paper 1401 is fed, head cover 305 also serves as a paper guide surface. In both paper feeding situations, paper is held between platen 2 and thermal head 3. Paper is incrementally fed by the rotation of platen 2 as a result of the frictional force provided between platen 2 and the paper.

During printing, heat generating element 311 of thermal head 3 is always retained at an optimal position for printing by the position setting mechanism including engaging portions 301, 302 described above. A paper detector 1303 mounted on paper guide 13 along the paper feed path of thermal paper 14 utilizes a reflection type photosensor to detect paper presence. An auxiliary roller 1304 mounted on paper guide 13 cooperates with platen 2 and assists in paper feeding. Paper is automatically fed by the rotation of platen 2 and printing is begun simply by inserting thermal paper 14 between platen 2 and auxiliary roller 1304. In this way, printer 100 operates by printing characters while thermal head 3 is in the down position.

Head subassembly 310 is biased towards platen 2 by torsion coil spring 8. Spring 8 is mounted about shaft 7 which serves as a center of rotation. Accordingly, spring 8 need not be located above head subassembly 310. This results in the reduction of the height of printer 100 allowing for a compact printer. When printing has not been conducted for a long period of time, first lever member 9 is operated to raise the head as shown in FIG. 5. In this state, a gap D of about 1 to 3 mm is created between thermal head 3 and platen 2 to prevent platen 2 from deforming. Also, in this position, the paper may be shifted to fine adjust the print position.

Figure 9:
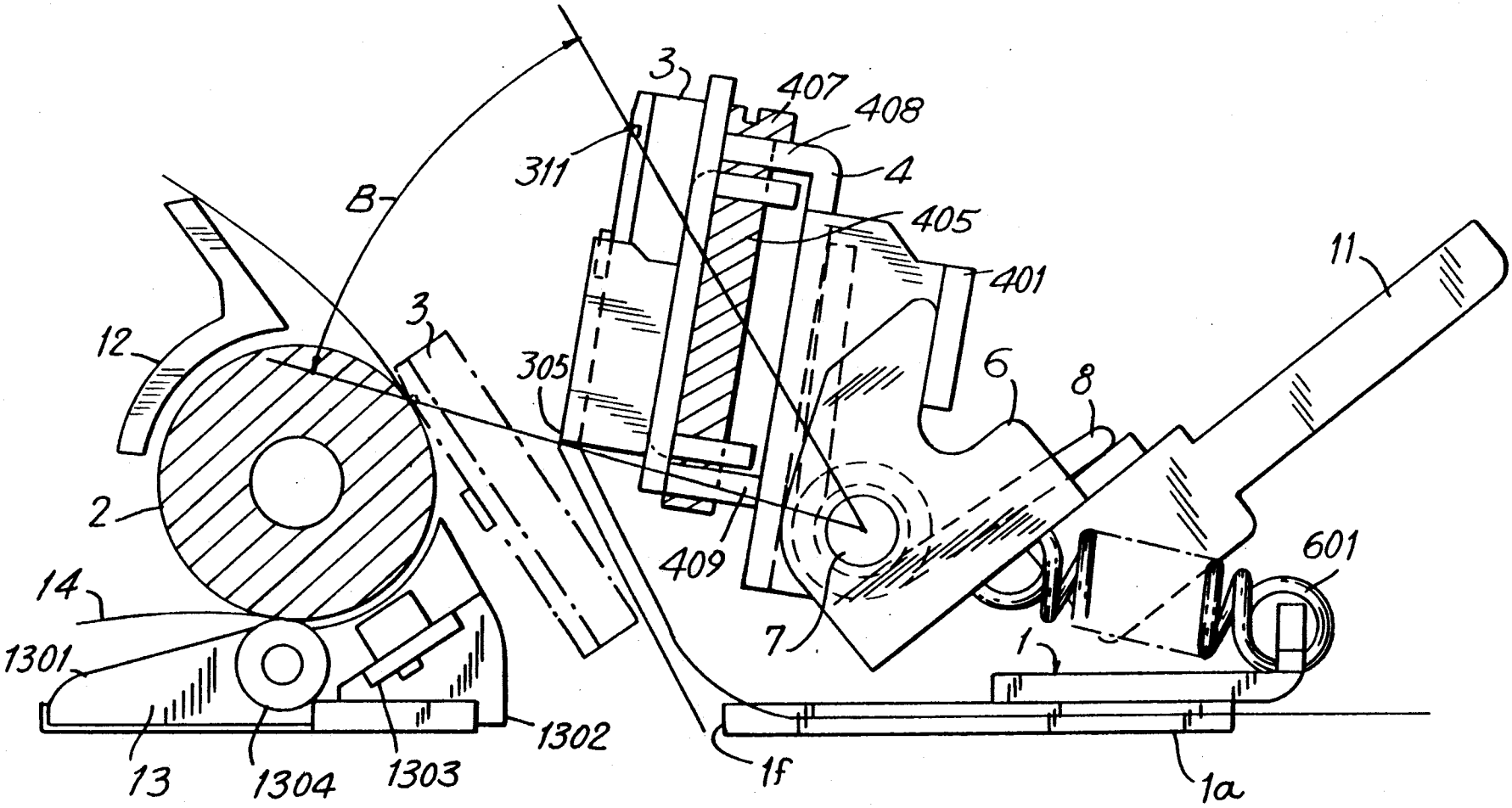
FIG. 9 is the cross-sectional view corresponding to FIG. 8 but in which the thermal head has been moved to an open position.

When second lever member 11 is operated, head subassembly 310 further rotates about shaft 7 as shown in FIG. 9 and moves a further distance away from platen 2. As a result, head subassembly 310 protrudes above the body of printer 100. In this state, the head is considered to be in the open state. This state is different from that in which the head is raised to an up position by operating first lever member 9. In the open state, thermal head 3 is rotated through an angle B of about 45°.

In the prior art, thermal line printer, when the head is in the open state, it rotates through an angle of less than 30°. In a preferred embodiment of the present invention, angle B is greater than 30°. Thermal head 3 is separated from platen 2 by a large distance, not achieved by operating the prior art lever, exposing the surface of thermal head 3. By opening thermal head 3 in this way, the user can easily clean thermal head 3 with a cotton swab or the like. Also, in this open state, thermal head 3 can be easily replaced and paper can be removed during paper jams. Generally, thermal head 3 is opened much more infrequently than it is raised to the up position. The construction is such that the levers 9 and 11 are independent of each other and additionally, may be formed of different colors to facilitate distinguishing them from each other. With such a structure, erroneous operation of either of the levers can be prevented.

Figure 10:
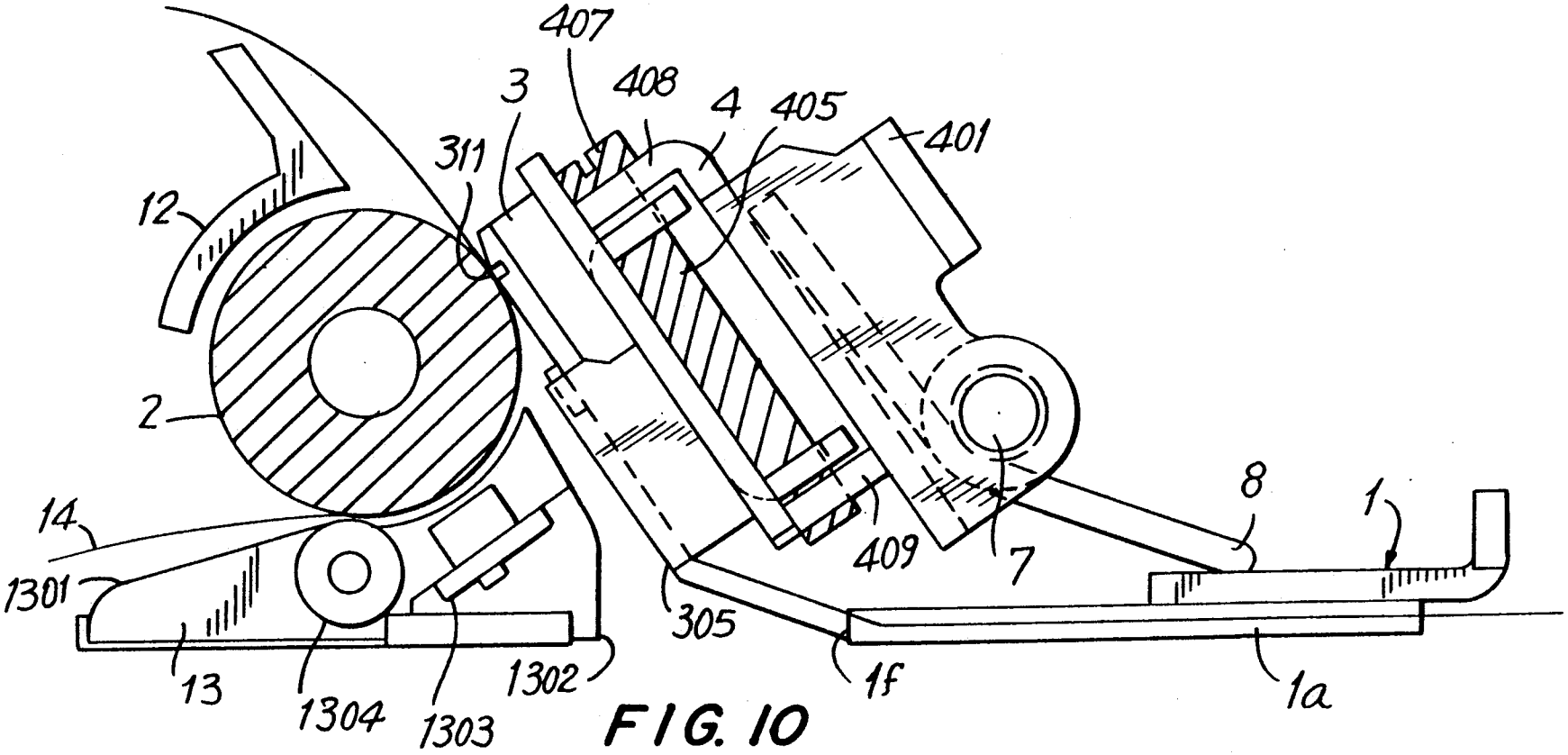
FIG. 10 is a cross-sectional view of a printer constructed in accordance with a second embodiment of the invention in which the head opening mechanism is omitted.

Such a structure for an opening mechanism lends itself to other benefits not found in the prior art. In another embodiment of the printer constructed in accordance with the invention as shown in FIG. 10, auxiliary member 6, second lever 11 and auxiliary spring 601 may be removed so that spring member 8 is mounted between head holding member 4 and frame bottom portion 1*a*. However, the head raising operation is performed in exactly the same way by operating first lever means 9 to open thermal head 3. This provides a low cost, disposable printer which may be disposed of after numerous uses. However, where a high grade printer is required, the printer which includes auxiliary member 6, second lever member 11 and auxiliary spring 601 is provided. Accordingly, where a lower grade printer is required, a reduction in cost and efficiency of material may be provided utilizing only a subset of the required structure of printer 100. Additionally, as the lower grade printer is a subset of the high grade printer, the subset of components may be mass produced to be utilized in both embodiments thereby providing economies of scale and material used during manufacture.

Figure 11:
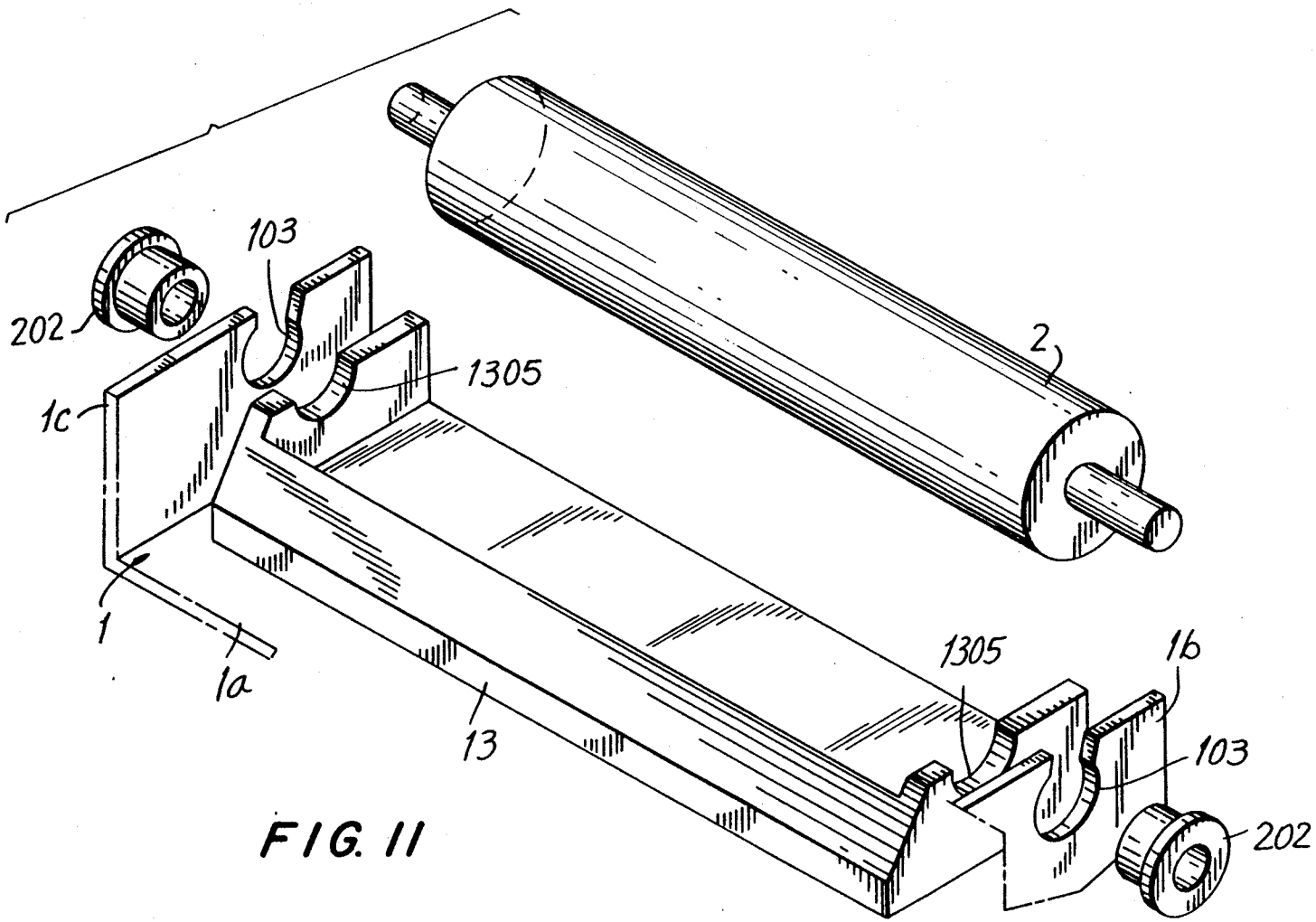
FIG. 11 is an exploded perspective view of a paper guide portion of the printer constructed in accordance with the invention.

Reference is now made to FIG. 11 in which the platen and platen support structure are shown in detail. Paper guide 13 is mounted on frame bottom portion 1*a*. Paper guide 13 is formed with bearing receiving grooves 1305 on opposed sides thereof. Additionally, frame side portions 1*b* and 1*c* are formed with bearing receiving portions 103. Respective bearing receiving portions 103 and 1305 receive and support therein bearings 202, permitting their axial insertion but not radial displacement. Platen 2 is supported between bearing pairs 202. Accordingly, platen 2 is pivotably mounted on frame 1 by bearings 202. Bearing pair 202 supports platen 2 in a manner that allows platen 2 to rotate relative to frame 1. Additionally, bearings 202 prevent paper guide 13 from moving upward. Paper guide 13 is anchored to frame 1 thereby. By providing such a platen support structure, paper guide 13 and platen 2 are supported within frame 1 without the need of screws. Accordingly, printer 100 can be assembled with improved efficiency. Additionally, if platen 2 is removed, paper guide 13 can also be removed. With such a structure, paper detector 1303 which is mounted on paper guide 13 and auxiliary roller 1304 may also be easily maintained. Further, paper dust may easily be removed and the gap between the inner surface of paper guide 13 and the surface of platen 2. That gap may be formed and accurately maintained since platen bearings 202 are in intimate contact with paper guide 13.

Figure 12:
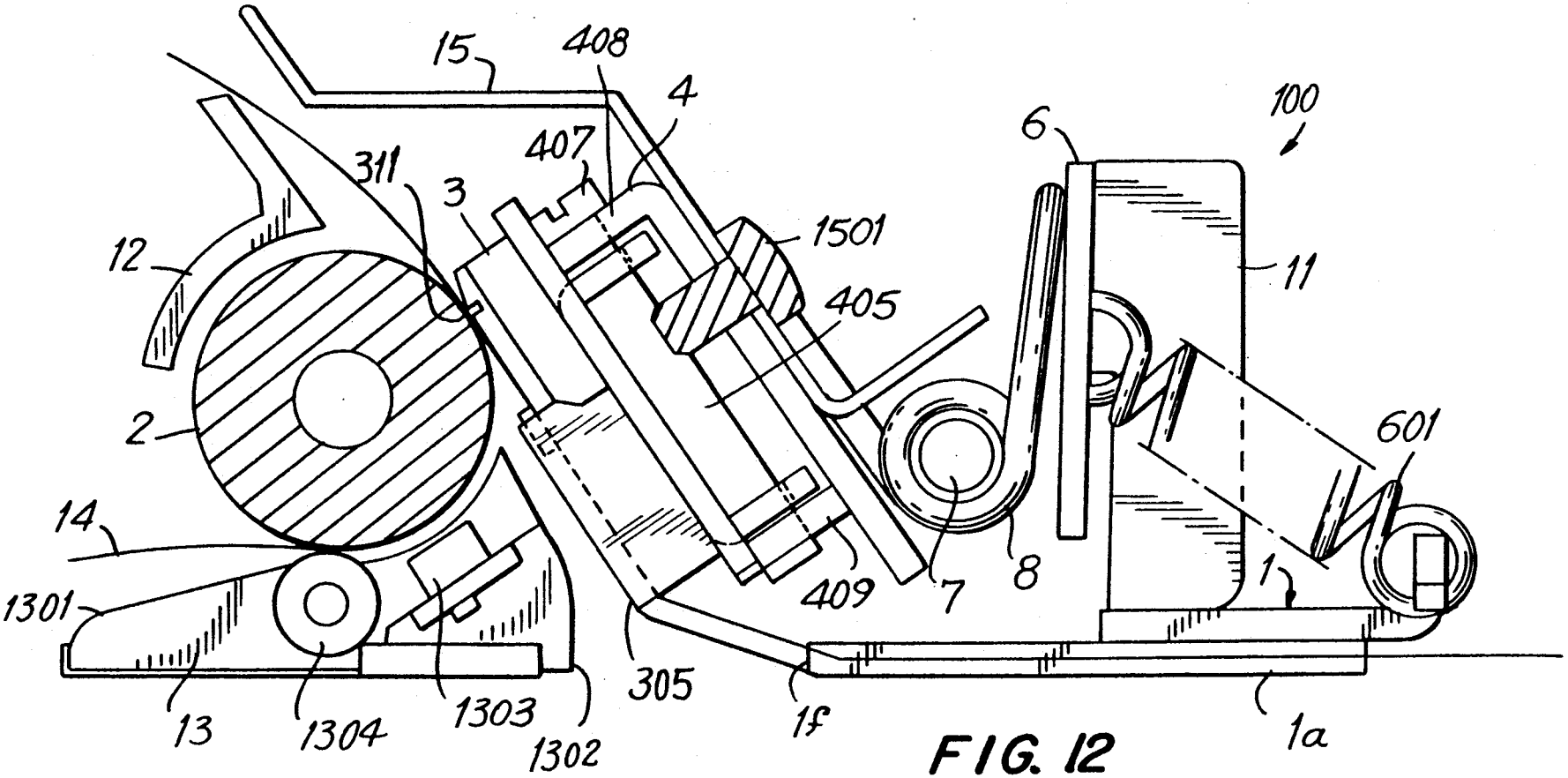
FIG. 12 is a sectional view of the printer constructed in accordance with the invention including a paper cutter.
Figure 13:
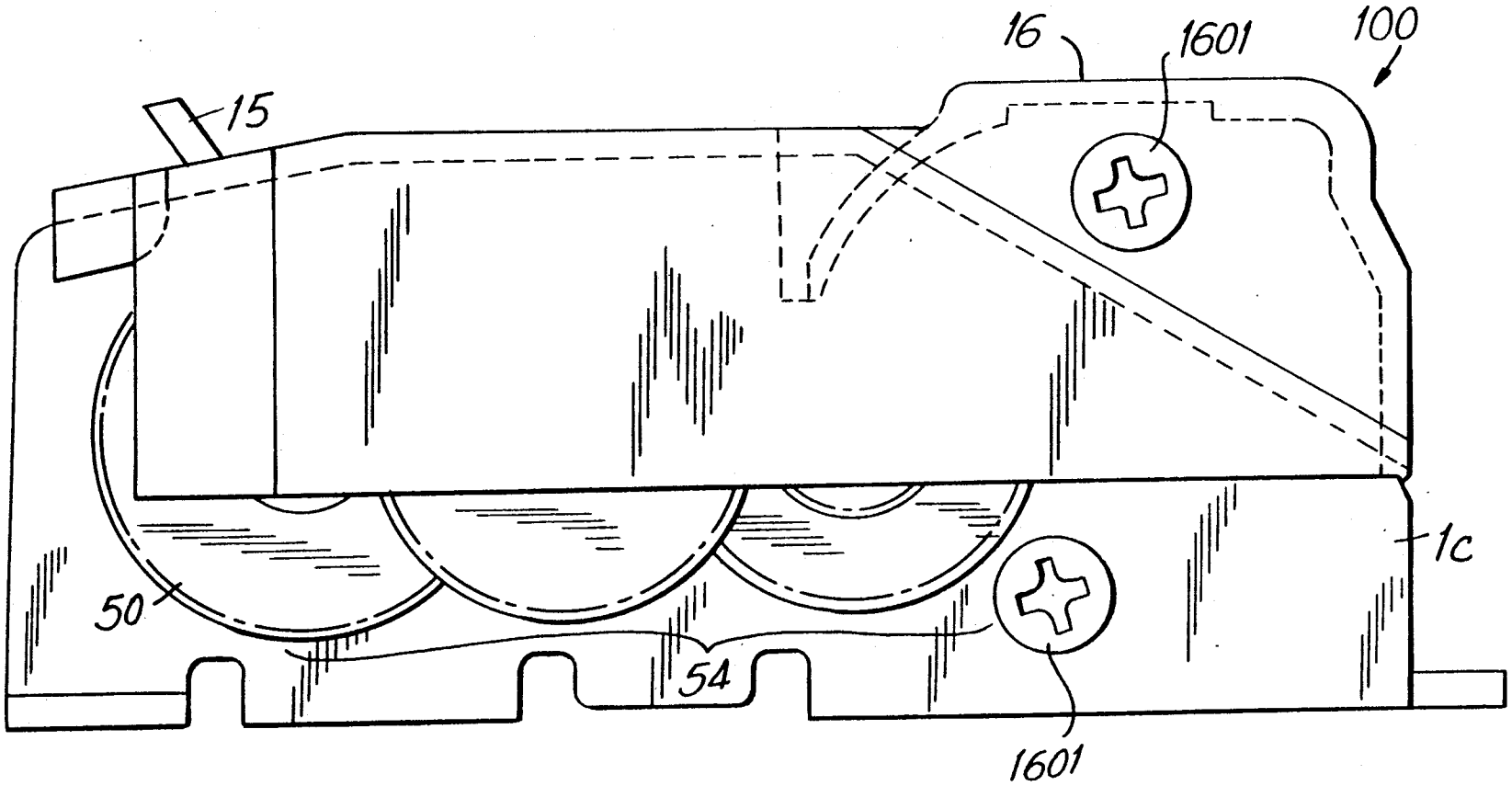
FIG. 13 is a side elevational view of the printer constructed in accordance with the invention including a motor cover.
Figure 14:
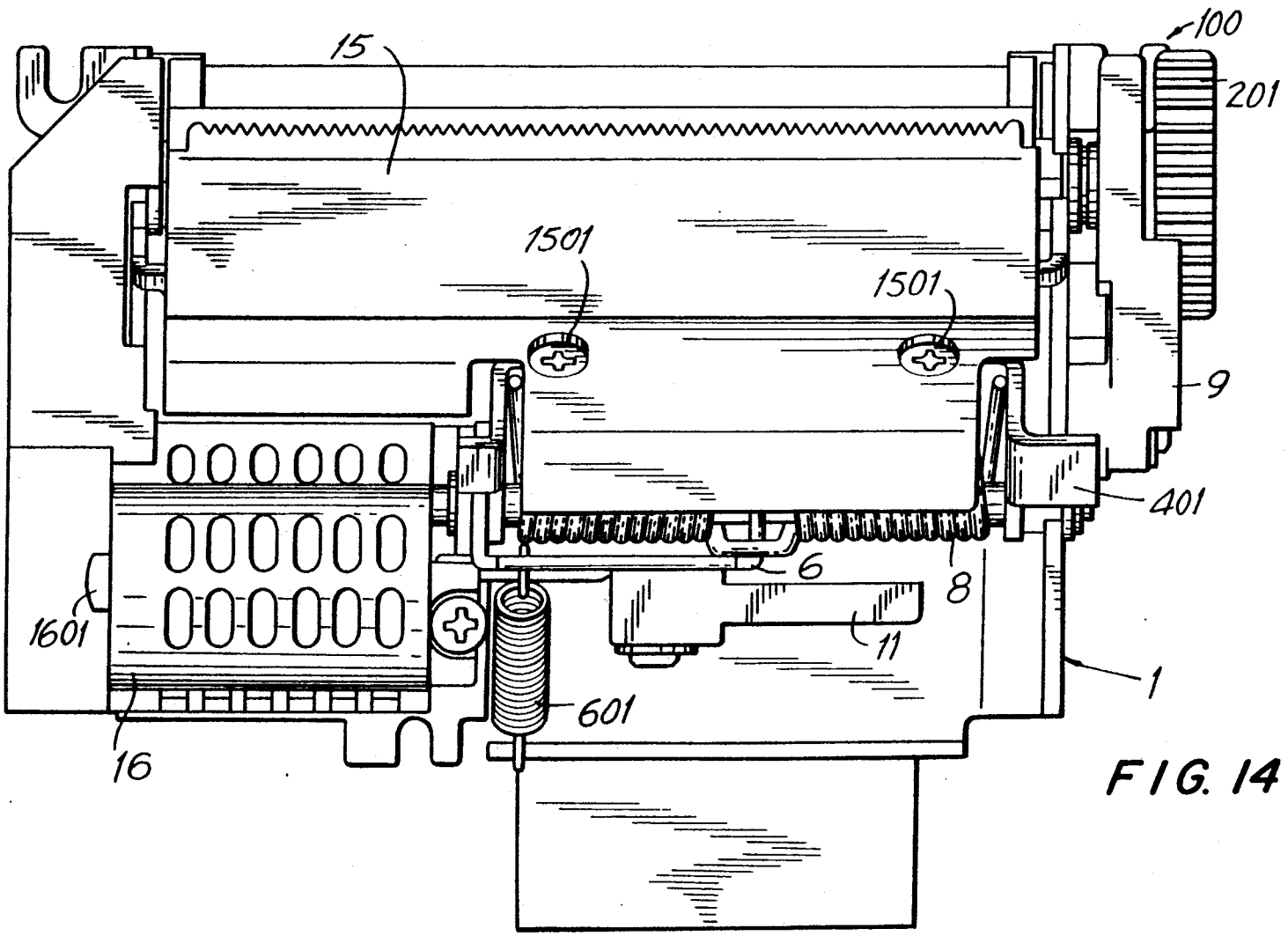
FIG. 14 is a top plan view of the thermal printer constructed in accordance with the invention including the paper cutter and motor cover.

As seen in FIGS. 12–14, printer 100 may also include a paper cutter 15 and a motor cover 16. Turning first to FIG. 12, paper cutter 15 may be mounted on the head holding member 4 utilizing a securing screw 1501. In prior art printers, the paper cutter is mounted to the frame and the top portion of the case. By mounting paper cutter 15 to head holding member 4, when thermal head 3 is in the up position, paper cutter 15 will move slightly away from platen 2 along with head subassembly 310 so that paper does not easily stick to paper cutter 15. Consequently, paper can be inserted within printer 100 with great ease. When thermal head 3 is in the open position, paper cutter 15 is moved a great distance from platen 2 and does not impede removal of the paper or cleaning of thermal head 3. The printed paper can be cut manually by pulling across the edge of paper cutter 15. Since paper cutter 15 totally covers head holding member 4, paper cutter 14 acts to protect head holding member 4 and to prevent foreign matter from falling into the printer. Thermal printer 100 gets hot. Paper cutter 15 also assures safety by preventing the user's hand from touching head subassembly 310.

Figure 15:
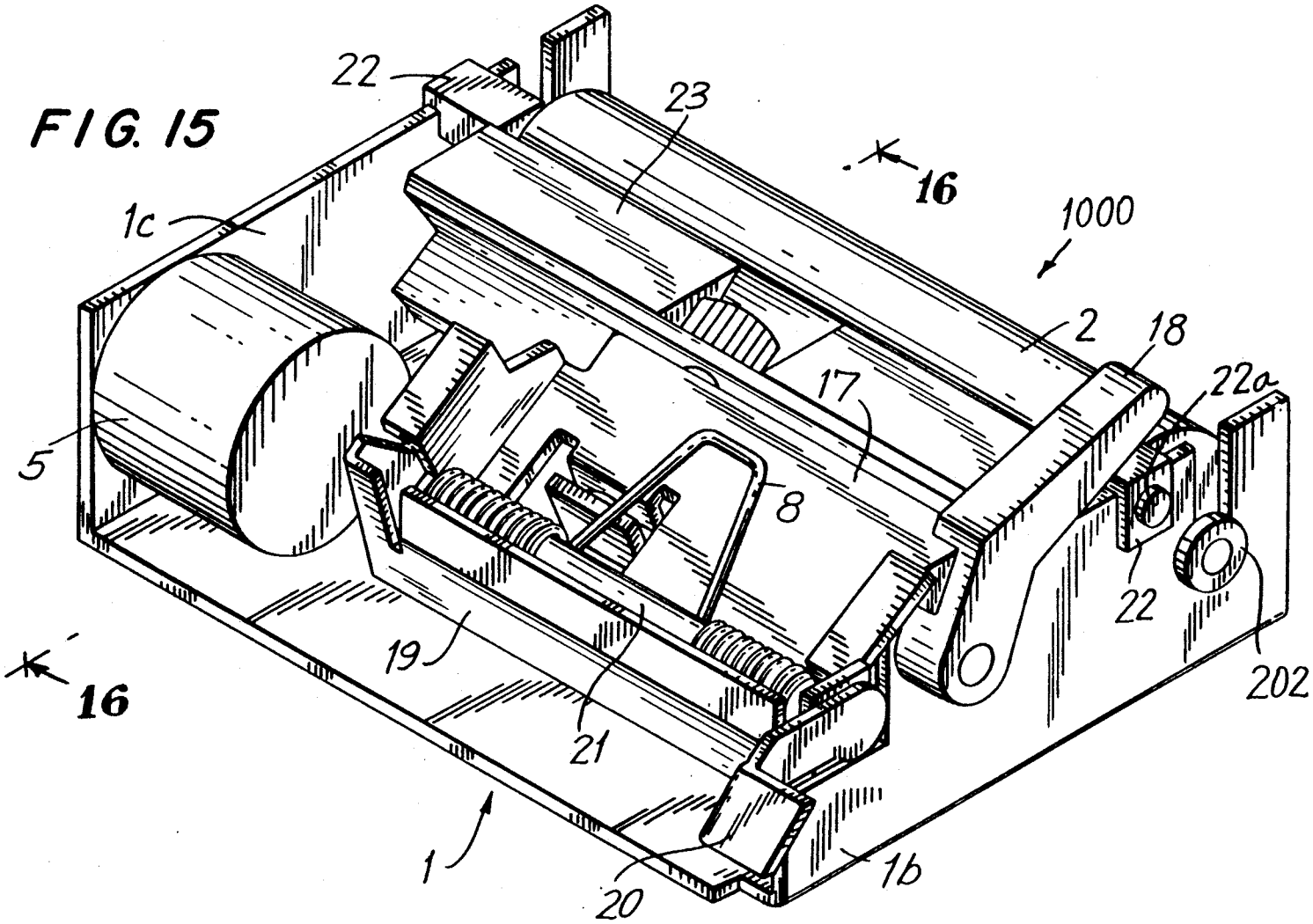
FIG. 15 is a perspective view of printer constructed in accordance with another embodiment of the invention.

A motor cover 16, only shown in FIGS. 13 and 15 for simplification of the drawings, is mounted on frame 1 and secured to frame 1 along with motor 5 by securing screws 1601 which are screwed into frame side portion 1*c*. Since motor 5 becomes hot during use, motor cover 16 provides the safety feature of keeping the hand of the user from touching motor 5. Cover 16 also covers gear train 54 preventing foreign matter from getting entangled in a gear. In the illustrated embodiment, paper is manually cut by the user. However, it is possible to attach a motor driven automatic paper cutter unit to head holding member 4.

Figure 16:
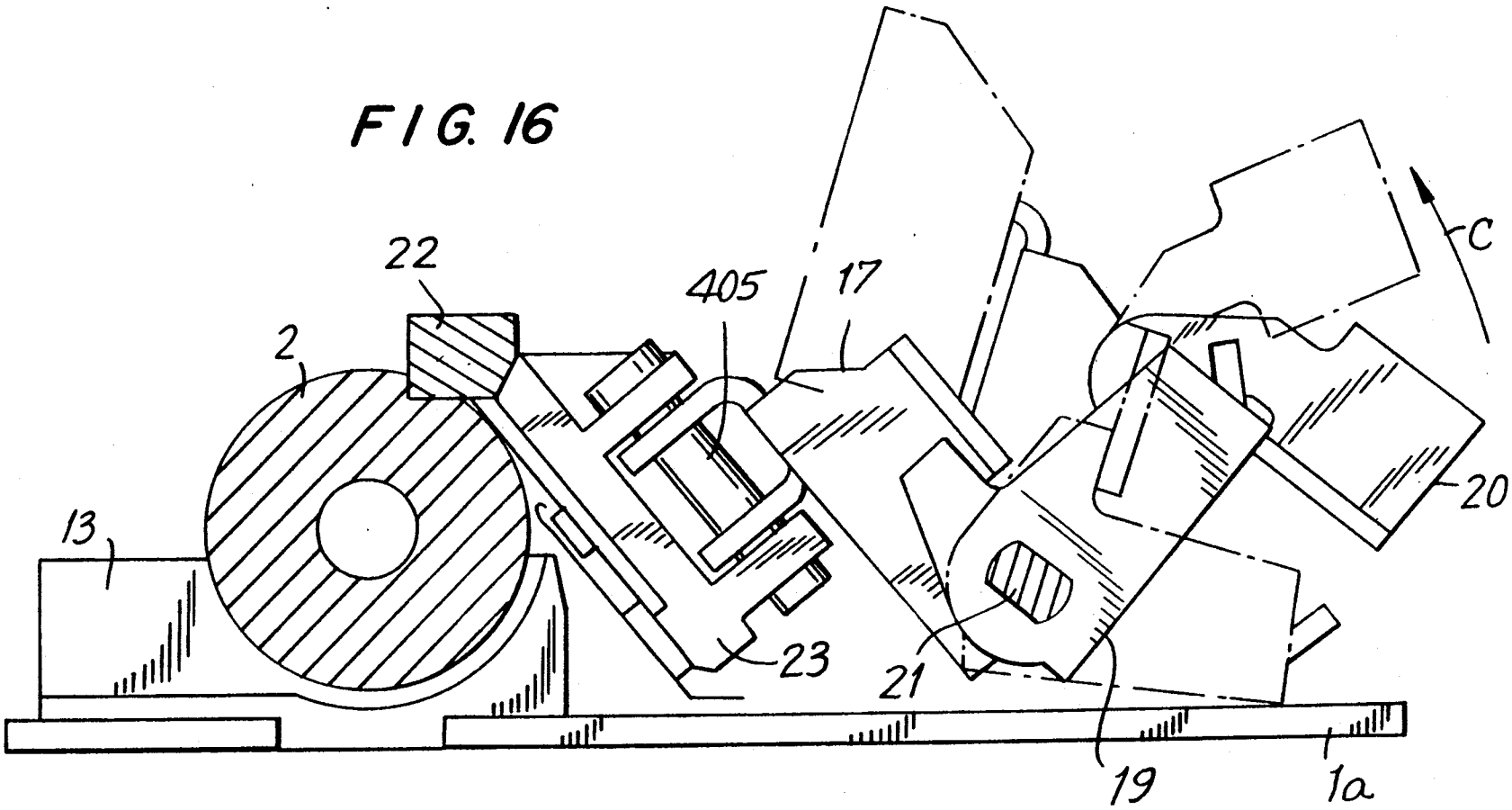
FIG. 16 is a sectional view taken along lines 16—16 of FIG. 15.

Reference is now made to FIGS. 15 and 16 in which a printer, generally indicated as 1000 constructed in accordance with a second embodiment of the invention is provided. Like numerals are utilized to indicate like structures of in the preceding embodiment. Printer 1000 is similar to printer 100, the difference being that a first lever member 18 of printer 1000, rotatably mounted on right side frame portion 1*b*, engages a head holding member 17 to raise or lower the head. An auxiliary member 19 is wider than head holding member 17. A second lever member 20 is mounted on right hand frame portion 1*b* rather than behind auxiliary member 19. The structure permits the manually operated portion of printer 1000 to be located close to thermal head 3. This allows frame 1 to be designed with a greater degree of freedom. However, auxiliary member 19 is wider than head holding member 17 in printer 1000, therefore, auxiliary member 19 is easily twisted or deformed by the spring force provided by spring 8. Accordingly, shaft 21 about which spring 8 is mounted and head holding member 17 rotates is not round to better anchor auxiliary member 19 to prevent such twisting. Shaft 21 and auxiliary member 19 are coupled together so that they rotate as a unit increasing mechanical strength.

To open thermal head 3, second lever member 20 is rotated in the direction indicated by arrow C, unlocking auxiliary member 19. A positioning mounting portion 22 is mounted on each of frame side portions 1*b*, 1*c* and bears against thermal head subassembly 23 to place the head subassembly in position.

The positions of position setting portions 22 can be fine adjusted during printing to obtain the optimum print position. Positioning setting portion 22 is mounted on frame 1 by a positioning screw 22*a*. If a slotted hole is formed within right frame portion 1*b* it becomes possible to move position setting portions 22 within a certain range securing it at preferable positions. As seen in FIG. 16, thermal head subassembly 23 is pressed towards platen 2. Platen 2 is rotated in a paper feeding direction, counterclockwise as viewed in FIG. 16, between platen 2 and thermal head subassembly 23. Thermal head subassembly 23 is raised up. Thermal head subassembly 23 is then brought in contact with position setting portions 22. Therefore, although there is little space between thermal head subassembly 23 and platen 2 in the standby condition, the platen 2 is rotated in position at a predetermined position during printing.

Figure 17:
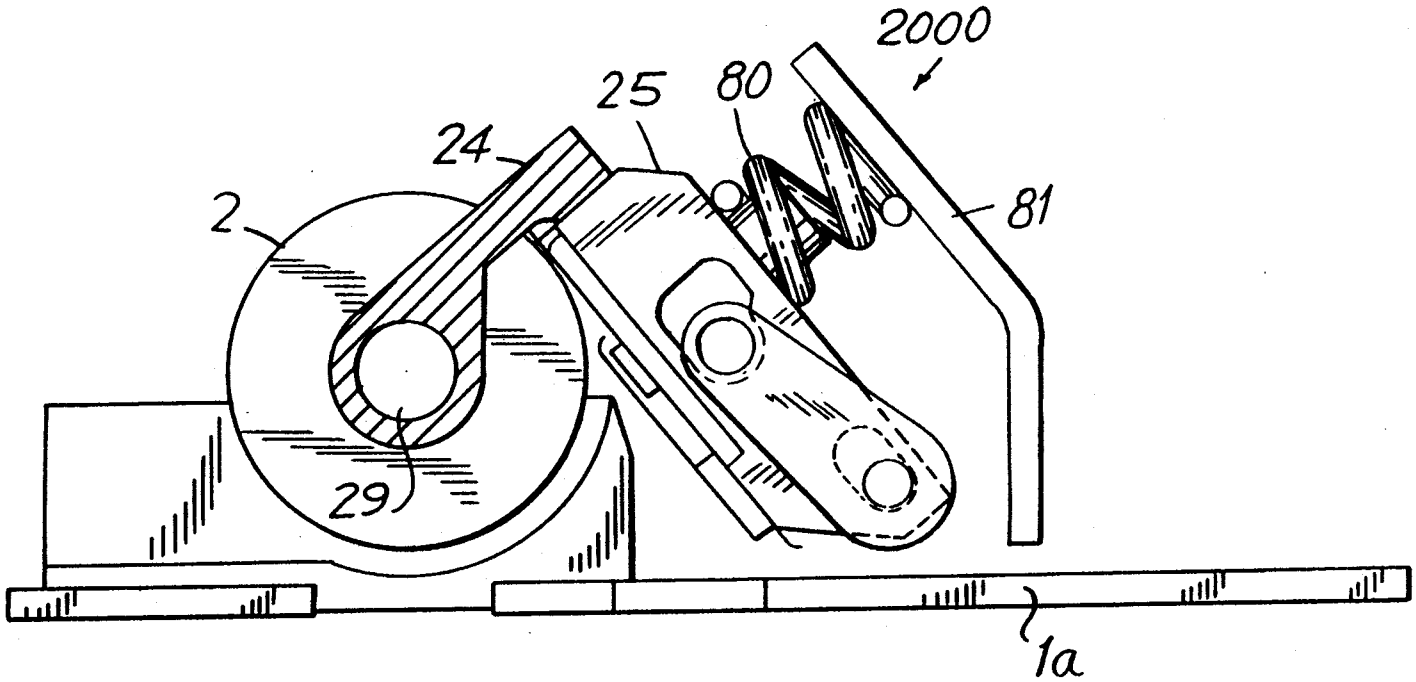
FIG. 17 is a cross-sectional view of a thermal line printer constructed in accordance with still another embodiment of the invention.

Reference is now made to FIG. 17 in which a printer, generally indicated as 2000 constructed in accordance with a third embodiment of the invention is provided. Only the left side elevational view is shown, which is the mirror image of the right side, to facilitate explanation. A platen 2 is formed with a shaft 29 at either end thereof. A pair of bearings 24 support platen 2 at either end by shaft 29. A portion of bearing 24 extends to the position of thermal head 25 to form angular position setting portions which place thermal head 25 in position. Thermal head 25 is biased toward platen 2 by a spring 80 mounted on a fixed plate 81. In this way, the position setting portions of printer 2000 which constitutes one feature of the invention can be formed by slightly modifying a portion (the platen) of the existing components of printer 1000 without fabricating new components.

Bearings 24 are mounted co-axially with platen 2. Therefore, the positioning relation of the bearings 24 to platen 2 can be easily and accurately established.

Figure 18:
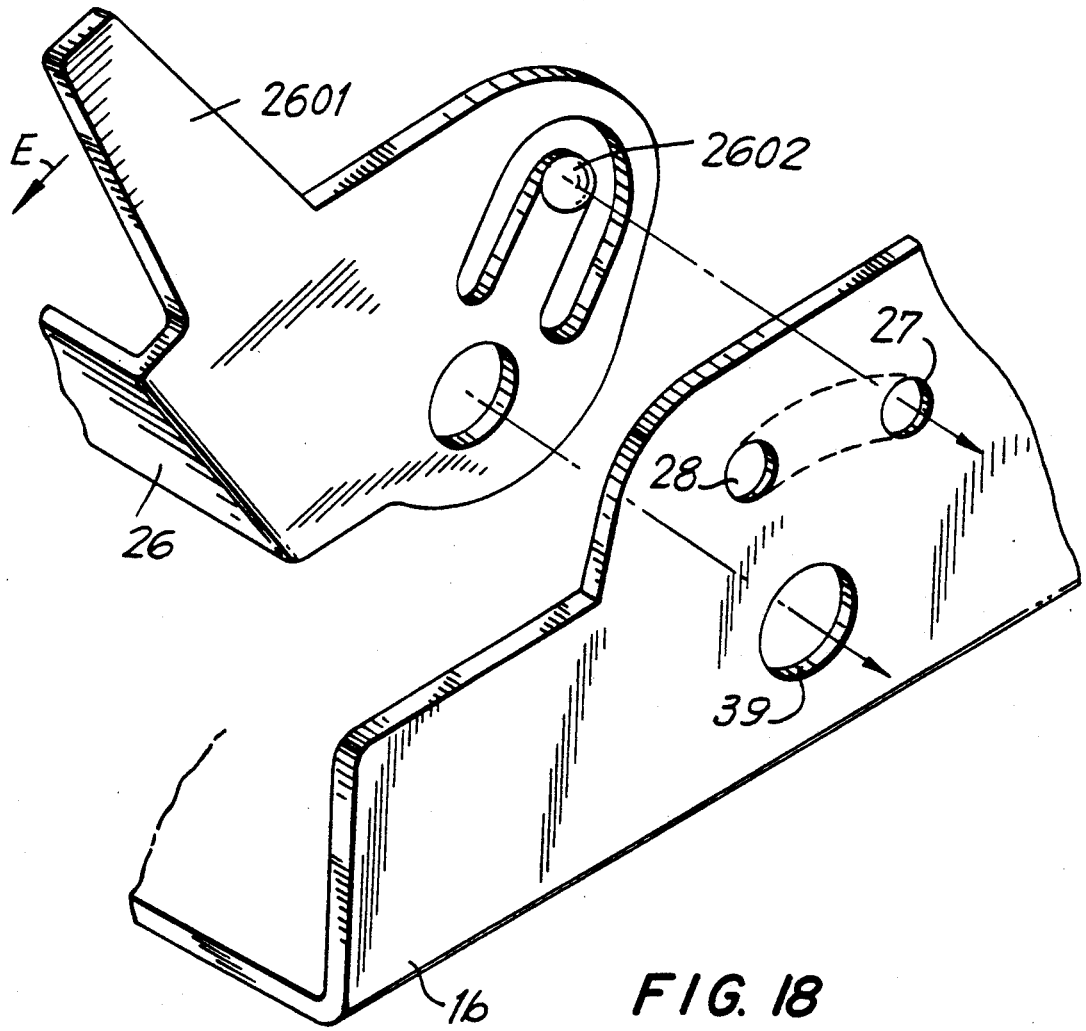
FIG. 18 is a fragmentary exploded view of a thermal line printer constructed in accordance with another embodiment of the invention.

Reference is now made to FIG. 18 in which a printer constructed in accordance with a fourth embodiment of the invention is shown. The fourth embodiment of the printer is similar to that of printer 1000, the primary difference being that an auxiliary member 26 is integrally formed with a lever 2601 which can be manually operated. In this way, the auxiliary member and the second lever are combined into a single unit resulting in a reduction in the number of components. A projection 2602 in the shape of a hemisphere is mounted on a displaceable tab 2603 formed in auxiliary member 26 and extends to engage a hole 27 formed in right side frame portion 1*b* to lock auxiliary member 26 in place. When the thermal head is to be opened, lever 2601 is rotated in the direction indicated by arrow E utilizing a large force sufficient to permit tab 2603 to flex and displace. This causes projection 2602 to disengage from hole 27 and engage a second hole 28 formed in right frame side portion 1*b* along the rotational path of projection 2602. Auxiliary member 26 is now locked in a second position. Lever 26 may be mounted upon a shaft (not shown) extending through a hole 39 formed in right frame side portion 1*b*.

Several embodiments of the invention have been described above. In each embodiment, the head subassembly is permitted to be raised to a great degree when the head is opened by incorporating the auxiliary member and the second lever member to a conventional printer. Thus, the surface of the thermal head is exposed for maintenance. This provides several benefits such as easy removal of paper during paper jams, thermal head maintenance such as cleaning and allows for the maintenance of the optimal print position of the thermal print head during printing. Hence, good print quality can be provided.

By providing a printer having a head holding member, auxiliary member and second lever member, the thermal head can be raised to open by performing a simple operation of the levers without the need to use any tool or the like. Therefore, maintenance for the printer is uncomplicated and simple.

Where the head subassembly moves a large distance, the accurate positional relation of the head to the platen need not be lost as in the prior art since the angular position setting portions formed on a part of the body of the printer are designed to receive engaging portions formed on the head subassembly which will bear against the angular position setting portions. This structure results in optimally maintaining the positional relationship between the head subassembly and the platen assuring good print quality. Additionally, normal operation for raising the head is possible even if the auxiliary member and the second lever member ar omitted. This structure therefore lends itself to the manufacture of a lower grade printer using many common components with a higher grade printer resulting in economies of scale in producing common elements to more than one printer. Moreover, by installing a paper cutter on the head holding member so that the paper cutter is moved far away from the platen when the head is opened. Therefore, the cutter is not a hindrance to removing paper jams or head cleaning operations.

The auxiliary member is locked by a second lever member formed as a lever. Therefore, the auxiliary member can be easily unlocked and rotated without using a tool or the like. When unlocked, the thermal head may be rotated through more than 30° separating the thermal head surface from the platen by a great distance allowing thermal head maintenance. By utilizing a torsion coil spring to bear on the auxiliary member which is not located above both the thermal head and the head holding member, the height of the printer is decreased leading to miniaturization of the printer. By maintaining the thermal print head in a given position during printing by angular position setting portions, a position which is best for printing is maintained by the thermal head and good print quality is stably maintained. Additionally, by providing such a structure, the angular position setting portions do not require special parts, but rather may be formed by angular extensions of already existing parts and grooves formed in the frame. For example, portions of the bearing supporting the platen can be made to place the thermal head in position. In this manner, the printer can be reasonably designed and simply constructed. Lastly, by combining the auxiliary member an the second lever member into a single unit, structural simplicity is obtained.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention in which, as a matter of language, might be said to fall therebetween.

What is claimed is:

1. A thermal line printer comprising a frame;

a platen rotatably mounted on said frame;

a thermal head;

head holding means pivotably mounted on said frame for holding said thermal head and pivotably displaces said thermal head between a first position, a second position and a third position;

first lever means for cooperating with said head holding means for moving the thermal head between said first position and second position;

a pivotable auxiliary member contacting with said head holding means;

biasing means for biasing said thermal head toward said platen and said auxiliary member away from said head holding means;

second lever means coupled to said auxiliary member for locking said auxiliary member in a predetermined position; and said second lever being operatively coupled to the auxiliary member so that movement of said second lever unlocks said auxiliary member, and permits said thermal head to move from said second position to said third position.

2. The thermal line printer of claim 1, wherein said first position is a closed position, said second position is an up position and said third position is an open position and wherein when said thermal head is in said third position, said thermal head is farther away from said platen then when said thermal head is in said first position.

3. The thermal line printer of claim 2, wherein said platen is separated from said thermal head by an angle greater than 30° when said thermal head is in said open position.

4. The thermal line printer of claim 2, further comprising auxiliary biasing means for biasing said auxiliary member toward said frame.

5. The thermal line printer of claim 1, wherein said head holding means is formed with a first engaging portion and a second engaging portion, said first lever means is formed with a cam portion which bears against said first engaging portion and said auxiliary member engages said second engaging portion.

6. The thermal line printer of claim 1, wherein said thermal head is rotated through an angle of more than 30° by movement from said first position to said third position upon unlocking said second lever means.

7. The thermal line printer of claim 1, wherein said thermal head has a first end and a second end, first positioning engaging portion coupled to said thermal head at said first end and a second positioning engaging portion coupled to said thermal head at said second end, and wherein said frame is formed with first and second grooves therein respectively in registration with said first and second positioning engaging portions, said position engaging portions being movable within said grooves and bearing on the surfaces of said groove when said thermal head is in an optimal printing position.

8. The thermal line printer of claim 1, wherein said thermal head has a first end and a second end, a first position engaging portion coupled to said thermal head at said first end and a second position engaging portion coupled to said thermal head at said second end, and further comprising bearing means for supporting the platen, said bearing means being formed with angular position setting portions cooperating with said first and second positioning engaging portions to position said thermal head at an optimal print position.

9. The thermal line printer of claim 1, further comprising a support shaft, said auxiliary member being pivotally mounted on said support shaft, said head holding means extending from the support shaft toward said platen and said biasing means being a torsion coil spring mounted on said support shaft, said head holding member being disposed between said platen and said auxiliary member.

10. The thermal line printer of claim 1, further comprising paper cutting means for cutting paper positioned about said platen, said paper cutting means being fixedly mounted on said holding member and moving therewith.

11. The thermal line printer of claim 1, wherein said thermal head is disposed between said platen and said second lever means, biasing means and head holding means, said second lever means auxiliary member and biasing means each being mounted on said frame, and further comprising a motor coupled to said platen for rotating said platen, said motor being mounted on said frame so that said thermal head is disposed between said motor and said platen and said head holding means is not disposed between said motor and said platen.

12. The thermal line printer of claim 1, further comprising paper guide means, said paper guide means being mounted on said frame and maintained in place by said platen, and bearing means mounted on said frame, said platen being supported between said bearing means.

13. The thermal line printer of claim 1, wherein said thermal head is supported at a single position of said thermal head by said head holding means.

14. The thermal line printer of claim 13, wherein said head holding means has a width less than the width of said thermal head, said head holding means not being substantially centered on said frame relative to said thermal head.

15. The thermal line printer of claim 1, further comprising motor means mounted on said frame, said motor means being coupled to said platen for rotating said platen and head dissipation means mounted on said frame for dissipating heat generated by said motor.

16. A thermal line printer comprising a frame;

a platen rotatably mounted on said frame;

a thermal head;

head holding means pivotably mounted on said frame for holding said thermal head and pivotably displaces said thermal head between a first position, a second position and a third position;

first lever means for cooperating with said head holding means for moving the thermal head between said first position and second position;

a pivotable auxiliary member contacting with said head holding means, said auxiliary member being integrally formed with a lever, said auxiliary member being pivotable between a first auxiliary member position and a second auxiliary member position and said frame and auxiliary member being formed with cooperating restricting means for defining the location of said first and second auxiliary member positions and for normally holding said auxiliary member at each of said first and second auxiliary member positions; and biasing means for biasing said thermal head toward said platen and said auxiliary member away from said head holding means.

17. A thermal line printer comprising a frame;

a platen pivotably mounted on said frame;

a thermal head;

head holding means pivotably mounted on said frame for holding said thermal head and rotating said thermal head between a first position, a second position and a third position;

first lever means for cooperating with said head holding means for moving the thermal head between said first position and second position;

an auxiliary member pivotably mounted and contacting with said head holding means;

biasing means for biasing said thermal head toward said platen and said auxiliary member away from said head holding means;

second lever means coupled to said rotating auxiliary member for locking said auxiliary member in a predetermined position;

said second lever being operatively coupled to the auxiliary member so that movement of said second lever unlocks said auxiliary member and causes said thermal head to move from said second position to said third position; said first position being a closed position, said second position being an up position and said third position being an open position, and when said thermal head is in said third position, said thermal head being farther away from said platen then when said thermal head is in said first position; and said platen being separated from said thermal head by an angle greater than 30° when said thermal head is in said open position.

18. The thermal line printer of claim 17, wherein said head holding means is formed with a first engaging portion and a second engaging portion, said first lever means is formed with a cam portion which bears against said first engaging portion and said auxiliary means engages with said second engaging portion.

19. The thermal line printer of claim 17, wherein said thermal head is rotated through an angle of more than 30° by said second lever means.

20. The thermal line printer of claim 17, wherein said thermal head has a first end and a second end, first positioning engaging portion coupled to said thermal head at said first end and a second positioning engaging portion coupled to said thermal head at said second end, and wherein said frame is formed with first and second grooves therein respectively in registration with said first and second positioning engaging portions, said position engaging portions being movable within said grooves and bearing on the surfaces of said groove when said thermal head is in an optimal printing position.

21. The thermal line printer of claim 17, wherein said thermal head has a first end and a second end, a first posit engaging portion coupled to said thermal head at said first end and a second position engaging portion coupled to said thermal head at said second end, and further comprising bearing means for supporting the platen, said bearing means being formed with angular position setting portions cooperating with said first and second positioning engaging portions to position said thermal head at an optimal print position.

22. The thermal line printer of claim 17, further comprising a support shaft, said auxiliary member being pivotably mounted about said support shaft, said head holding means extending from the support shaft toward said platen and said biasing means being a torsion coil spring mounted on said support shaft, said head holding means being disposed between said platen and said auxiliary member.

23. A thermal line printer comprising a frame;

a platen rotatably mounted on said frame;

a thermal head;

head holding me mounted on said frame for holding said thermal head and rotating said thermal head between a first position and a second position; and first lever means for cooperating with said head holding means for moving the thermal head between said first position and said second position, said first position being a closed position and said second position being an open position, wherein said thermal head is farther away from said platen when said thermal head is in said second position than when in said first position, said thermal head having a first end and a second end, first positioning engaging portion coupled to said thermal head at said first end and a second positioning engaging portion coupled to said thermal head at said second end, and wherein said frame is formed with first and second grooves therein respectively in registration with said first and second positioning engaging portions, said positioning engaging portions being movable within said grooves and bearing on the surfaces of said groove when said thermal head is in an optimal printing position.

24. The thermal line printer of claim 23, wherein said head holding means is formed with a first engaging portion, said first lever means being formed with a cam portion which bears against said first engaging portion.

25. The thermal line printer of claim 23, wherein said first lever means causes said platen to be separate from said thermal head by an angle greater than 30° when said thermal head is in said open position.

26. The thermal line printer of claim 23, wherein said thermal head is supported by said head holding means at a single position on said thermal head.

27. The thermal line printer of claim 26, wherein said head holding means has a width less than the width of said thermal head, said head holding means not being substantially centered on said frame relative to said thermal head.

* * * * *